United States Patent [19]

Theurer

[11] 4,232,610

[45] Nov. 11, 1980

[54] MOBILE APPARATUS FOR LAYING RAILWAY TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 912,299

[22] Filed: Jun. 5, 1978

[30] Foreign Application Priority Data

Jun. 16, 1977 [AT] Austria ..... 4282/77

[51] Int. Cl.[3] ..... E01B 29/02

[52] U.S. Cl. ..... 104/3; 51/178; 104/15; 212/73; 212/224

[58] Field of Search ..... 104/2, 3, 4, 15; 51/178; 212/12, 15, 16

[56] References Cited

U.S. PATENT DOCUMENTS

| | | | |
|---|---|---|---|
| 355,884 | 1/1887 | Murgatroyd | 212/15 |
| 2,458,050 | 1/1949 | Blondelle | 212/15 |
| 3,366,075 | 1/1968 | Clayborne et al. | 104/15 |
| 3,635,164 | 1/1972 | Patton | 104/2 |
| 4,046,077 | 9/1977 | Theurer et al. | 104/2 |

FOREIGN PATENT DOCUMENTS

| | | | |
|---|---|---|---|
| 304711 | 7/1916 | Fed. Rep. of Germany | 212/15 |
| 487703 | 12/1929 | Fed. Rep. of Germany | 104/3 |
| 1235164 | 6/1971 | United Kingdom | 104/15 |

*Primary Examiner*—John J. Love
*Assistant Examiner*—Ross Weaver
*Attorney, Agent, or Firm*—Kurt Kelman

[57] ABSTRACT

A mobile apparatus for laying railway track comprises a car running on the rails and a carrier frame with a track on which a power-driven trolley is mounted. The trolley includes a beam for carrying and laying an assembled section of the railway track including rails fastened to ties. A vertically and transversely adjustable flash butt welding machine is arranged below the carrier frame and in the region of the region of the forward end of the car for welding the rails of the assembled railway track section laid by the beam to the rails on the railway track whereon the car is mounted. Associated with the welding machine are devices for removing the welding bead resulting from the flash butt welding of the rails to each other.

5 Claims, 3 Drawing Figures

MOBILE APPARATUS FOR LAYING RAILWAY TRACK

The present invention relates to a mobile apparatus for laying railway track including rails fastened to ties defining cribs therebetween, and more particularly to such apparatus comprising a car mounted for mobility on the rails of the railway track in an operating direction, and a carrier frame having a track and a power-driven trolley mounted on the carrier frame track, the trolley including a beam for carrying and laying an assembled section of the railway track including rails fastened to ties.

Austrian Pat. No. 244,376 discloses an apparatus of this general type, wherein the carrier frame is supposted at the ends thereof on cars running on the railway track. This apparatus has the disadvantage that, after the assembled track sections have been laid, their rails must be provisionally connected to the adjacent rails of the track by fishplates to enable the entire mobile apparatus to advance in the operating direction during the track laying operation. The rails of the laid track sections must then be permanently connected in a subsequent operation.

According to German Pat. No. 568,555, this subsequent rail joining operation may be simplified by the use of an apparatus mounted for mobility on the track rails and carrying a special welding head for flash butt welding the abutting rail ends together. While this mobile apparatus has had considerable commercial success, it still requires an additional operating stage in laying new tracks. The use of this mobile welding machine is made more difficult in such track laying operations since the provisionally joined rail ends of the newly laid assembled track sections are usually out of alignment after the mobile track laying apparatus has moved thereover. Therefore, before the abutting rail ends can be properly flash butt welded, they must be suitably positioned parallel to each other and with respect to the welding head, thus requiring an additional correcting operation.

It is the primary object of this invention to improve mobile track laying apparatus of the indicated type and to increase the speed of the track laying operation by producing a track ready for traffic.

The above and other objects are accomplished in such an apparatus according to the invention with a vertically and transversely adjustable flash butt welding device below the carrier frame and in the region of the forward end of the car for welding the rails of the assembled railway track section laid by the beam to the rails of the railway track whereon the car is mounted, and means associated with the flash butt welding device for removing the welding bead resulting from the flash butt welding of the rails to each other.

In an unexpectedly simple manner, such an apparatus for the first time makes it possible to lay railway tracks in a continuous operation by permanently joining together the rails of adjacently laid assembled track sections to produce continuous welded rails in a single operation. This makes it possible to combine the advantages of laying new tracks over relatively short distances with the time- and personnel-saving method of laying assembled track sections with those of the high-quality rail connections obtained by flash butt welding. Since a single apparatus is used for laying the track and welding the rails, investment costs are also reduced.

The above and other objects, advantages and features of the present invention will become more apparent from the following detailed description of a now preferred embodiment, taken in conjunction with the accompanying schematic drawing wherein.

Figures 1, 2, 3:
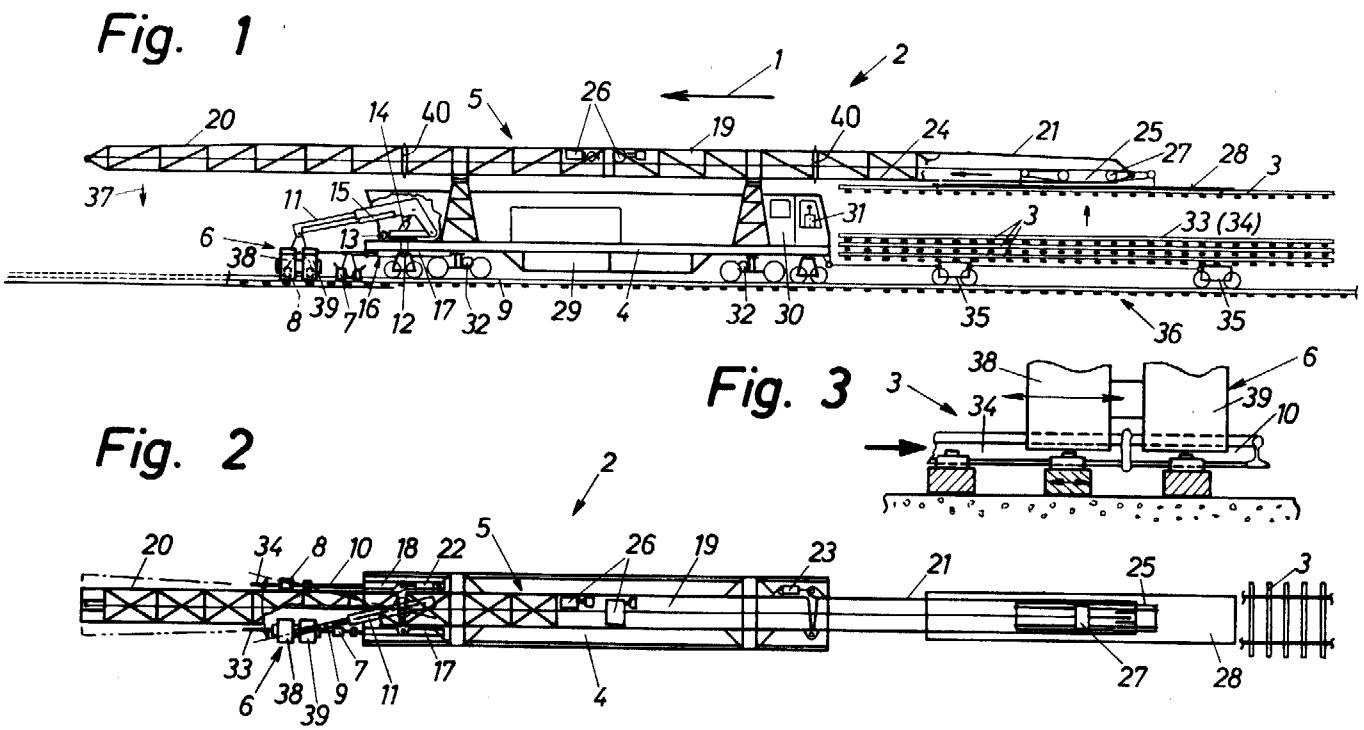
FIG. 1 is a side elevational view of the mobile apparatus.
FIG. 2 is a top view of the apparatus of FIG. 1.
FIG. 3 is an enlarged side view of the apparatus at the welding station where two abutting rail ends are flash butt welded together.

Referring now to the drawing, there is seen mobile apparatus 2 for laying railway track including rails 9, 10 fastened to ties defining cribs therebetween, the apparatus comprising car 4 mounted for mobility on rails 9, 10 of railway track 36 in an operating direction indicated by arrow 1. Car 4 has a forward end 16. Carrier frame 5 is supported on the car and has track 24, and a power-driven trolley 25 is mounted on the carrier frame track for movement therealong, the trolley including beam 28 for carrying and laying an assembled section of the railway track including rails 33, 34 fastened to ties.

A vertically and transversely adjustable flash butt welding device 6 is arranged below the carrier from and in the region of forward end 16 of car 4 for welding rails 33, 34 of assembled railway track section 3 laid by beam 28 to rails 9, 10 of railway track 36 whereon car 4 is mounted. Means 7, 8 are associated with flash butt welding device 6 for removing the welding bead resulting from the flash butt welding of the rails to each other.

In the illustrated embodiment, flash butt welding device 6 is mounted on overhang beam 11 mounted on forward end 16 of car 4 and projecting forwardly therefrom. The overhang beam is telescopingly slidable in a bellcrank lever support and power drive means consisting of hydraulic motors 13, 14, 15 are arranged to move beam 11 vertically, transversely and in the direction of the railway track. The illustrated embodiment comprises a turntable mounted rotatably about perpendicular pivot pin 12 on forward end 16 of car 4, the turntable supporting the bellcrank lever support for overhang beam 11 and being rotatable by hydraulic motor 13 for swinging the beam and flash butt welding device in a direction transverse to the elongation of carrier frame 5. Hydraulic motor 14 enables the beam and welding device to be moved vertically and hydraulic motor 15 moves the beam in the direction of the railway track relative to the bellcrank lever support. In this manner, overhang beam 11 supports flash butt welding device 6 for selective operation in the range of the railway track rails upon movement of the beam, as shown in FIG. 2.

Furthermore, the means for removing the welding bead resulting from the flash butt welding of the rails to each other includes a bead removing device 7, 8 associated with, and above, each rail 33, 34 being welded, respectively, to rails 9, 10, and additional power drive means consisting of hydraulic motors 17, 18 are arranged for positioning the welding bead removing devices 7, 8 relative to flash butt welding device 6 and independently thereof, thus enabling the welding bead removing means to follow the welding device in any selected position.

This illustrated arrangement enables the track laying operation to proceed with high efficiency since the welding bead may be removed at one side of the track after the respective rails there have been welded together while overhead beam 11 is swung to the other side of the track to weld the rails there at the same time that the welding bead is removed at the other rail. Also, proper adjustment of the welding bead removing devices may be effected independently of the movement of the welding device.

Operation of hydraulic motors 15, 17 and 18 enable flash butt welding device 6 and welding bead removing devices 7, 8 to be adjusted at a distance from forward car end 16, the distance corresponding to several, preferably six or seven, crib widths.

The support of carrier frame 5 on car 4 and the support of the welding and welding bead removing devices 6, 7, 8 independently thereof on or in front of the car has the advantage that the latter are not carried by the carrier frame which, therefore, can be constructed more simply and lighter since it is not subjected to the load of the operating devices. Furthermore, the positioning of these devices is also greatly facilitated by this construction. Using respective welding bead removing devices for the two rails, each one associated with, and above, one rail has the advantage that each device may be centered during the welding operation. Thus, no time is lost for adjusting the welding bead removing device after welding has been completed, this adjustment being carried out during the welding operation.

The illustrated carrier frame 5 has a central part 19 supported on car 4 and two overhanging arms 20, 21 projecting from respective ends of the car. A respective pivot 40 connects each carrier frame arm to the central carrier frame part and extends substantially perpendicularly to the plane of the railway track. Power drive means consisting of hydraulic motors 22, 23 connect carrier frame arms 20, 21 to central carrier frame part 19 for pivoting the arms transversely to the elongation of the carrier frame. Drive 26 enables trolley 25 to be moved along track 24 of carrier frame 5 and a cable-operated lifting device 27 suspends beam 28 for carrying and laying an assembled section of the railway track from the trolley.

The pivotal arrangement of overhanging carrier frame arms 20, 21 makes it possible to pick up the assembled track sections 3 from flat cars carrying the same without difficulty and to lay these track sections proper alignment, particularly in track curves, so that the abutting ends of the rails to be welded together are accurately aligned.

In the illustrated apparatus, a central power source 29 for all the power drive means is supported in a central region of car 4, this source in the illustrated embodiment being a hydraulic fluid sump suitably connected to the hydraulic motors constituting the power drive means in a hydraulic control circuit. Operator's cab 30 is also mounted on car 4 and holds control panel 31 for operating the power drive means. The illustrated apparatus is self-propelled, car 4 having a power drive means 32 also connected to the hydraulic control circuit and operable from control panel 31. This central control of all operations further enhances the efficiency of the apparatus, integrating all operational steps and enabling the entire machine to be serviced and maintained with considerable savings in cost despite the fact that it incorporates two operating units in one machine.

Assembled sections 3 of the railway track including rails 33, 34 fastened to ties are transported on turntables mounted on flat cars 35 running on rails 9, 10 of previously laid track 36.

The operation of the apparatus for laying a railway track section 3 and welding its rails to the rails of a previously laid track will now be described in detail:

As shown in FIG. 1, rails 33, 34 of assembled track section 3 are gripped by rail clamps arranged on beam 28 which is first lowered by hoist 27 to grip the assembled track section and is then raised by the hoist with the assembled track section. In the raised position, assembled track section 3 is moved by trolley 25 from overhanging arm 21 over operator's cab 30 along central carrier frame part 19 to carrier frame arm 20, the trolley running along track 24 of carrier frame 5. Upon reaching the forward position above the location where the assembled track section is to be laid, i.e. when the ends of rails 33, 34 are spaced from forward end 16 of car 4 in the direction of track elongation by about 3 to 4 meters or about 6 to 7 crib widths, hoist 27 is operated to lower assembled track section 3 in the direction of arrow 37 onto the previously prepared and planed ballast bed, with the ends of rails 33, 34 abutting the adjacent ends of rails 9, 10 of the previously laid railway track on which the apparatus moves in the operating direction indicated by arrow 1.

Flash butt welding device 6 is now brought into position for welding the abutting ends of rails 10 and 34 together by suitable operation of hydraulic motors 13, 14, 15 which position device 6. The welding device has a pair of clamps 38 and 39 for clamping the device to rails 10 and 34, the clamps at the same time serving to conduct electric current to the flash butt welding device. The pulsating longitudinal movement between rails 10 and 34 required for the butt welding operation is obtained by displacing the rails of assembled track section 3 by a relative movement between clamps 38 and 39. The welding is completed by pressing the abutting rail ends together and the clamps are then released from the rails, whereupon welding device 6 is swung over to the other side for welding together rails 33 and 9 in the same manner. At the same time, welding bead removing device 8 is positioned by operation of hydraulic motor 18, which supports device 8 on car 4, to enable the device to grind off the welding bead at the abutting ends of rails 34 and 10, at least in the region of the rail head but, preferably, over the entire rail.

While the abutting ends of rails 9 and 33 are welded together, device 7 is suitably centered and adjusted so that it may begin its grinding operation immediately after the welding of the abutting rail ends has been completed so that the welding and grinding steps at both rails proceed continuously and without any loss of time. After the abutting rail ends at both rails have been welded together and the welding beads have been ground off, mobile apparatus 2 is advanced by operation of motor 32 in the direction indicated by arrow 1 until the ends of rails 33, 34 of the newly laid assembled track section project about four meters from forward end 16 of car 4. The apparatus is now in position for laying the next assembled track section received from flatcar 35.

In track curves, carrier frame arms 20 and 21 will be pivoted suitably about pivots 40 to center the assembled track sections properly.

Obviously, the power drive means need not be hydraulic motors, as described and illustrated herein by way of example, but any suitable power drives may be used. Similarly, the construction of the carrier arm and of the movable hoist may vary widely.

As shown in FIG. 1, car 4 has not only two main under-carriages with wheels driven by motors 32 but also has auxiliarly undercarriages which are particularly useful in laying heavy assembled track sections including concrete ties to enable the loads to be distributed over the rails during the laying of such track sections.

What is claimed is:

1. A mobile apparatus for laying railway track including rails fastened to ties defining cribs therebetween, which comprises (a) a car mounted for mobility on the rails of the railway track in an operating direction, the car having a forward end, (b) a carrier frame having (1) a track and (2) a power-driven trolley mounted on the carrier frame track, the trolley including a beam for carrying and laying an assembled section of the railway track including rails fastened to ties, (c) a vertically and transversely adjustable flash butt welding device below the carrier frame and in the region of the forward end of the car for welding the rails of the assembled railway track section laid by the beam to the rails of the railway track whereon the car is mounted, (d) means associated with the flash butt welding device for removing the welding bead resulting from the flash butt welding of the rails to each other, (e) an overhang beam mounted on the forward end of the car and projecting forwardly therefrom, (f) power drive means for moving the beam vertically, transversely and in the direction of the railway track, (1) the flash butt welding device being mounted on the overhang beam for selective operation in the range of one of the rails of the railway track upon movement of the beam, and (g) additional power drive means for positioning the welding bead removing means relative to the flash butt welding device and independently thereof, (1) the welding bead removing means including a bead removing device associated with each of the rails.

2. The mobile apparatus of claim 1, wherein the carrier frame is supported on the car and has an overhanging arm projecting forwardly of the forward end thereof, and the flash butt welding device and welding bead removing means are supported on the car below the overhanging arm and are mounted adjustably at a distance from the forward car end, 3. The mobile apparatus of claim 1, wherein all the power drive means are hydraulic motors.

4. The mobile apparatus of claim 1 or 3, further comprising a power drive means for the car, a central power source for all the power drive means mounted on the car, an operator's cab on the car and a control panel in the cab for operating the power drive means.

5. The mobile apparatus of claim 1, wherein the carrier frame has a central part supported on the car and two overhanging arms projecting from respective ends of the car, and further comprising a respective pivot connecting each of the arms to the central part and extending substantially perpendicularly to the plane of the railway track for pivoting the carrier frame arms transversely to the elongation of the carrier frame, and power drive means connecting frame arms to the central part for pivoting the arms.

* * * * *